United States Patent [19]

Deneuville et al.

[11] Patent Number: 4,768,440

[45] Date of Patent: Sep. 6, 1988

[54] WARHEAD FOR MISSILES

[75] Inventors: Pierre Deneuville, Soisy Sur Seine; Ellio Perez, La Celle Saint Cloud, both of France

[73] Assignee: Matra, Paris, France

[21] Appl. No.: 52,905

[22] Filed: May 22, 1987

[30] Foreign Application Priority Data

May 23, 1986 [FR] France ..... 86 07406

[51] Int. Cl.[4] ..... F42B 13/18

[52] U.S. Cl. ..... 102/495; 102/306; 102/475; 102/701; 102/473

[58] Field of Search ..... 102/305, 473, 475, 491–497

[56] References Cited

U.S. PATENT DOCUMENTS 3,675,577 7/1972 Steinberg et al. ..... 102/474

3,741,123 6/1973 Dittrich ..... 102/491

FOREIGN PATENT DOCUMENTS 138640 4/1985 European Pat. Off. .

*Primary Examiner*—Harold J. Tudor

*Attorney, Agent, or Firm*—Fleit, Jacobson, Cohn & Price

[57] ABSTRACT

A warhead for a guided missile initiated by a proximity fuse, for use against high speed high altitude targets, comprises a fragmentation casing, an outer explosive charge contained in the casing and having a detonator and an inner explosive charge radially separated from the outer charge by an empty space. The inner charge has a detonator and is so arranged that the outer charge is detonated by the shockwave travelling through the radial space. On the other hand, the inner charge does not detonate following explosion of the outer charge. The charges are so shaped that the fragments from the casing are distributed as a radially directed isotopic shower.

6 Claims, 2 Drawing Sheets

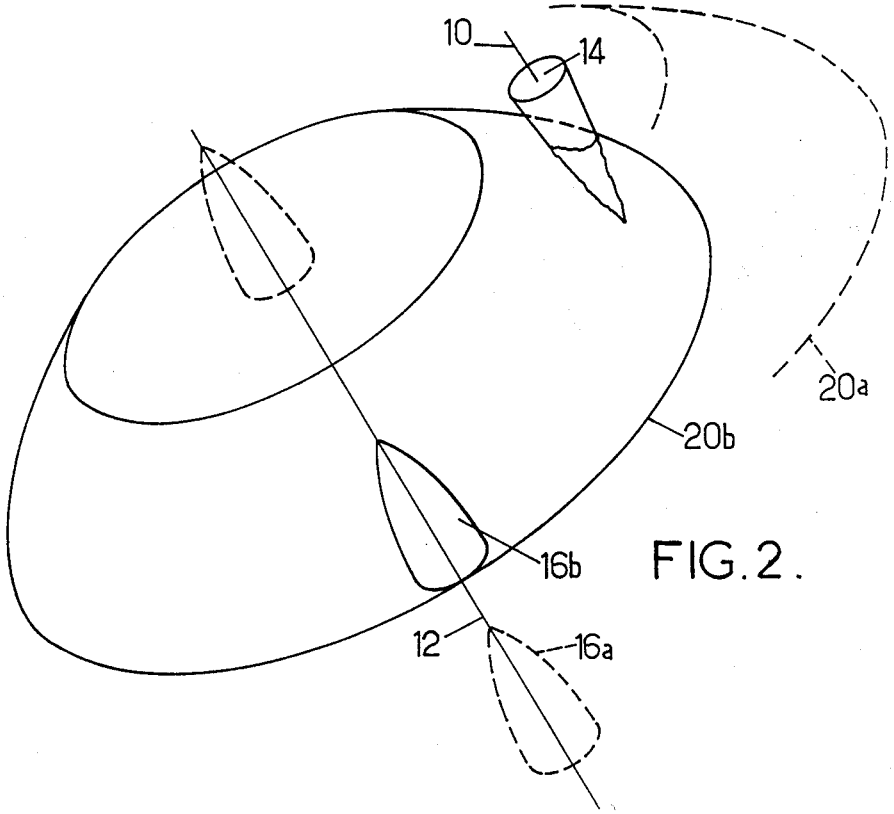
FIG. 2.
FIG. 3.
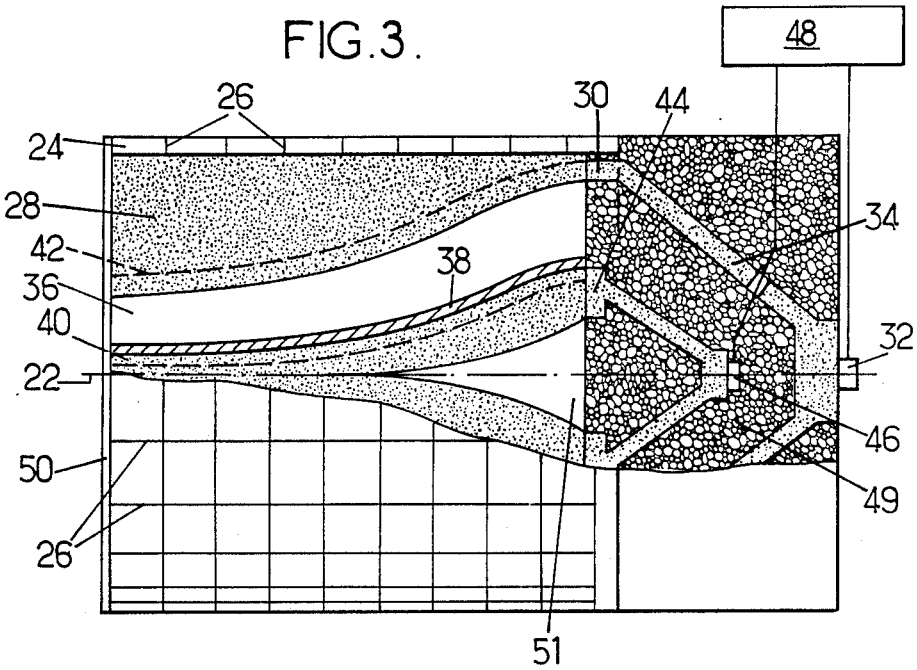

WARHEAD FOR MISSILES

BACKGROUND OF THE INVENTION

Technical Field

The invention relates to a warhead for a guided missile or the like initiated by a proximity fuse, for use against targets which enter the atmosphere at high speed and from a high altitude. It is particularly suitable for use in self guided ground to air missiles for defence against re-entry cones which, when they dive towards the atmosphere, have a speed typically of from 3 to 30 km/sec at an altitude which may exceed 50 km (150,000 ft).

Prior Art

Against such targets, at very high speed, a direct hit is very unfrequent. However, it is generally agreed that lethal structural damage to the target is obtained if the cumulated kinetic energies of the shroud fragments striking the target exceed a predetermined threshold, whose value depends on the nature of the target and that result is searched by firing the explosive charge of the warhead under appropriate conditions.

For that purpose, warheads for missiles having a proximity fuse have been designed which comprise a fragmentation casing or shroud containing two concentrically located explosive charges, the inner charge being radially separated from the outer charge by an empty space. The inner charge is provided with a detonation train while the outer charge is detonated by the shock wave travelling through the radial space. To increase the lethal power of the warhead, the two charges are so shaped that the fragments from the casing are distributed as a radially directed isotropic shower, substantially perpendicular to the warhead axis, and have almost equal kinetic energies (European No. 138,640). Other dual charge warheads are known, for instance from U.S. Pat. No. 3,675,577 (Sternberg).

SUMMARY OF THE INVENTION

The invention uses a completely different approach. It is based on the finding that, when the target travels at very high speed, the kinetic energy imparted to the fragments only plays a quite minor role. It is sufficient to locate fragments of sufficient individual weight in the path of the target and in front of the target for the latter to be damaged by them, due to its own speed. If there is sufficient damage, then the target will desintegrate during its re-entry into atmosphere. The problem to be solved is then completely modified. It consists in forming a "curtain" of fragments as dense and as homogeneous as possible on the estimated path of the target and in front of the latter.

In other words, for destruction of a target travelling at high speed, a solution is provided which consists in dispersing a cloud of fragments in a zone traversed by its path which is of sufficiently small size for the number of impacts to be sufficient for causing a high probability of structural kill.

For a predetermined target and a given weight spectrum of fragments, there exists a minimum or critical number of fragments per unit of surface perpendicular to the path of the target.

Optimization is achieved by dispersing fragments as a radial homogeneous cloud of uniform density, just greater than the critical density and of a size just greater than a prescribed minimum size under conditions of initiation selected depending on the distance at which the target passes.

A priori, it seems hardly possible to implement that approach since the relative positions of the paths of the warhead and the target at the time of near miss cannot be anticipated at the time of firing the missile.

However, it has additionally been found that, since the path of very high speed missiles (and particularly ballistic missiles) varies within small limits only and is close to the vertical, meeting occurs while the speeds of the missile and the target are almost parallel and are in opposite directions. It is consequently possible to provide the missile with an on-board computer associated with a proximity fuse and which determines, a few milliseconds before the target and warhead are at a minimum distance, a mathematical model of the relative movement and the optimum fragment distribution zone, defined by its coordinates along the path and radially thereto.

According to the invention, there is provided a warhead whose outer charge has separate detonation means and is so arranged that its detonation will not cause that of the inner explosive charge.

In normal military use, that arrangement would be rejected since firing the outer charge alone leaves the inner charge unused whereas, in existing warheads, it is sought to increase the kinetic energy of the fragments to the maximum possible extent.

With this construction of the head, a few milliseconds before reaching the point of the path corresponding to minimum distance, the missile "intelligence" will select between firing the outer charge or firing the inner charge. The outer charge is so shaped that it forms a concentrated "shower" of fragments distributed at low speed as a disk surrounding the head location. That method of activation will be used when the minimum distance d computed from an estimation of the paths is less than a prescribed threshold $d_0$. The inner charge is so arranged that, in the second case, the fragments are distributed as a partially toroidal annular surface which will be traversed by the target. The second method of activation will be used when the minimum distance d is greater than the threshold $d_0$. The optimum time of activation will be computed by evaluating the time required for the detonation to form the cloud of fragments immediately in front of the target, in the path thereof. Furthermore, by properly selecting the advance time of detonation with respect to the instant when the estimated paths cross, the mean distance between the path of the head and the fragment, when the target arrives in the cloud of fragments, may be adjusted.

The invention will be better understood from the following description of preferred embodiments given by way of examples only.

BRIEF DESCRIPTION OF THE DRAWINGS

FIGS. 1 and 2 are diagrammatic views illustrating relative positions of the paths of a warhead carrying a missile and a target and the desired distribution of the fragments in each case;

FIG. 3 shows an embodiment of a missile warhead according to the invention;

DETAILED DESCRIPTION OF PREFERRED EMBODIMENTS

Figure 1:
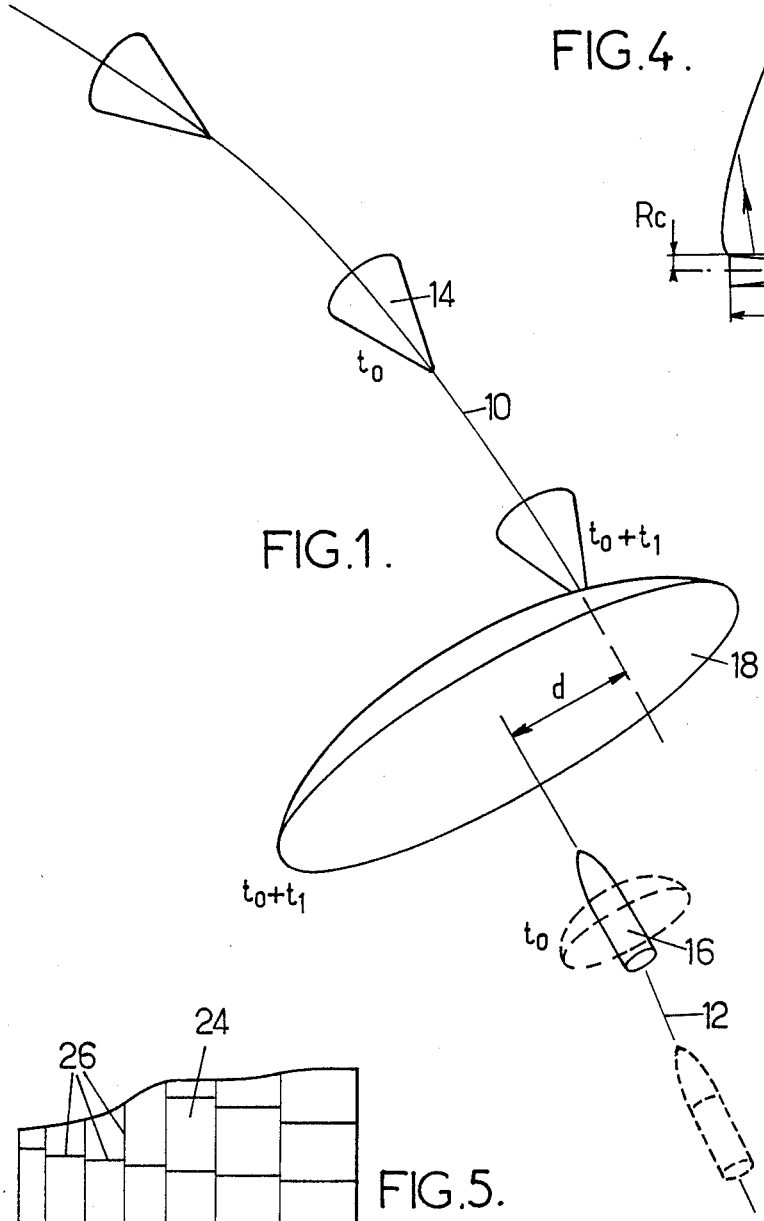

Referring to FIG. 1, lines 10 and 12 show the closing paths followed by a re-entry cone 14 and a missile 16 provided with a seeker, illustrated in the positions they have at a same time $t_0$. The missile 16 has a proximity fuse and an on-board computer which, from successive measurements of the positions of the target 14 of the parameters of the path 12, computes the relative movement of the warhead with respect to the target and, particularly, the minimum distance d of the two paths and the time $t_0+t_1$ at which the distance will be shortest.

The warhead of missile 16 is provided for selectively delivering either of two different distributions of fragments. Referring to FIG. 1 again, with a miss distance d lesser than a predetermined threshold $d_0$, the frageements must be scattered as homogeneously as possible in a disk shaped zone 18. For that purpose, the fragments should be radially projected within a continuous spectrum of low radial speeds. Referring to FIG. 2, the miss distance d is greater than threshold $d_0$. Then a better probability of target kill will be obtained by scattering the fragments homogeneously in a zone having a part toroidal shape **20*b*, defined by an internal circle and an external circle of such diameters that the re-entry cone 14 traverses the zone. For that purpose, greater radial speed should be imparted to the fragments, with a speed distribution which will cause scattering to occur in the zone at the time it is traversed by the re-entry cone. That result will require that the warhead is detonated at a time corresponding to position 16*b*. It will be appreciated that premature detonation when the warhead is at location 16*a* would result in a cloud of fragments in zone 20*a***, which would be much less inefficient.

Referring to FIG. 3, a warhead which makes it possible to obtain either the distribution of FIG. 1 or the distribution of FIG. 2 at will has a rotational symmetry about an axis 23. The warhead has a cylindrical casing or shroud 24 weakened along lines which define homogeneous fragments. As illustrated, casing 24 has two mutually orthogonal sets of weakening lines 26. However, other arrangements would be possible.

Casing 24 contains two concentrically located explosive charges 28 and 40. The radially outer explosive charge 28 has a thickness which is variable along the axis. Its cylindrical external surface is in contact with casing 24. It is provided with a detonation train which initiates the explosive charge at the narrower end thereof. As illustrated, the explosive train comprises an annular firing detonator 30 initiated by a central ignitor 32 and an explosive relay 34.

Figure 4:
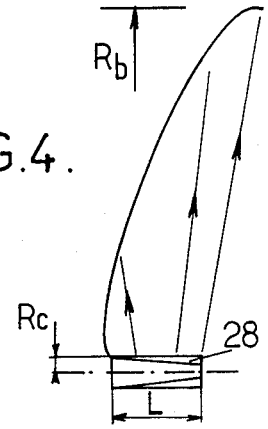
FIG. 4 is a diagram showing the distribution of the speeds of the fragments in a plane passing through the axis of the outer charge.

Before the warhead is further described, it will be shown how outer charge 28, when detonated alone, scatters fragments with a distribution as shown in FIGS. 1 and 4. The speed imparted to the individual fragments by explosive charge 28 is variable depending upon the original location of the fragments in the axial direction.

Figure 5:
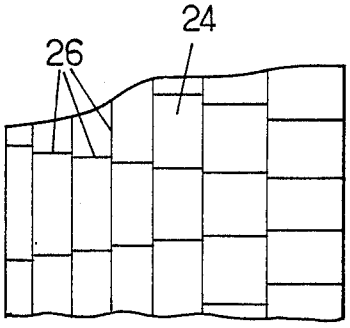
FIG. 5 is a detail views showing a possible prefragmentation of the casing.

Rather than defining fragments having the same size throughout the length of the warhead, it may be preferable to locate the pre-fragmentation lines in such a way that the number of fragments per circumferential row is greater in the rows confronting the thicker portions of the explosive charge 28. Such an arrangement is illustrated in FIG. 5. It results in a fragment distribution which is more homogeneous, i.e. which provides a cloud where the number of fragments per unit surface varies in much lesser proportions than otherwise. The longitudinal size of the fragments increases and their circumferential size decreases from the end where the explosive charge 28 is thinner to the end where it is thicker.

The axial distribution of initial speeds to be given to the fragments for obtaining a "screen" having a regular distribution of fragments in a zone of prescribed external diameter may be computed. For example, with a charge projecting fragments in a radial direction, the relation which gives the variation of radial speed along the axis is as follows:

$$V_x/V_M = [1/1-(R_c/R_b)]\left\{\sqrt{1-(R_c/R_b)^2\frac{x}{L}+(R_c/R_b)^2}-(R_c/R_b)\right\}$$

in which:

x: initial abscissa of a fragment along the axis $V_x$: initial speed of a fragment of initial abscissa x $V_M$: initial speed of a fragment of initial abscissa x+L (maximum speed)

L: length of the charge $R_c$: external radius of the charge $R_b$: external radius of the screen to be obtained when it is penetrated by the target.

The radial shape of charge 28 may be defined from the initial speed law and the determination of the forward or rearward slope of the path to be imparted to the fragments.

For increasing the diameter of the screen of fragments provided by the outer charge, its length and weight should be increased if the screen is to have a disk shape. According to the invention, the drawback is overcome by providing a warhead such that, when $R_b$ exceeds a predetermined threshold, a shower of fragments is formed distributed over an annular zone (FIG. 2) and no longer over a disk shaped zone.

For that purpose, the warhead of FIG. 3 comprises an inner explosive charge separated from the external charge by an annular expansion space and having its own detonation system.

Due to the provision of the expansion space, it is possible:

either to detonate the outer explosive charge without initiating the inner explosive charge, or to detonate the inner explosive charge causes the outer charge to detonate.

The inner explosive charge is preferably covered with a shroud 38 which dynamically confines the detonation products and initiates the outer charge when striking it.

The radially inner charge is shaped for delivering a shower of fragments which is similar to the external half of the fragments shower delivered by the outer charge.

For avoiding undesired detonation of the inner charge following initiation of the outer charge, the inner charge (or at least its outer portion defined by the broken line in FIG. 3) consists of an explosive composition which has a low sensitivity. Such a composition may for instance comprise a plastic binder with a low content of octogene and triaminotrinitrobenzene mixture (TATB) as a lower sensitivity explosive and, inside the latter, an explosive having good propellent properties, such as an octogene composite. The low sensitivity explosive may typically be a composite including a polyurethane binder and an octogene-TATB mixture with 60% wt. of TATB.

As illustrated in FIG. 3, the outer charge may also be composite in construction. Then it typically consists of an inner zone (defined by the broken line 42) having explosive easy to ignite by impact (such as an octogene-pentrite composite) and an external zone with a propellent explosive such as an octogene composite.

The system for initiating the inner charge may be similar to that for the outer charge and may comprise an annular relay 44 connected to an ignitor 46 by a detonating ring (explosive wires for example). Selection oand activation of the relay are carried out by an electronic circuit 48 associated with the proximity fuse (not shown). The firing systems may be embedded in an inert mass 49 (molded polytetrafluoroethylene) or polyamide for example). A central cavity 51 will typically be provided in the charge 40 and occupied by a synthetic material foam.

The foam of the charges, in cross-section along a plane passing through the axis, may be directly computed starting from the prescribed fragments speeds at each point of the axis and from the propagation speed of the detonation wave. The thickness of the explosive composition 28 in contact with relay 30 will in general be just greater than the minimum required for detonation to occur since no substantial radial speed is required. The thickness of space 36 will be large enough for the casing 38 to accelerate to the required speed; a value of about 1 cm will generally be sufficient.

Numerous modifications are possible. The warhead may be symmetrical to facilitate confinement of the detonation products in the zone where the explosive charge 28 is thicker. For that, the end plate 50 of FIG. 3 may be replaced by a unit symmetrical with that shown in the Figure. The shower then has, in section, a bell shape including the mirror image of that of FIG. 4. Explosives other than those given by way of examples may be used and the low sensitivity explosive layer may be replaced with inert material in contact with casing 38. The latter may for example be of copper to be deformable. The explosive of the outer charge will typically be formed of a composite which resists vibrations and has a high energetic explosive contact (octorane for example). Finally, casing 26 may have a shape other than cylindrical, e.g. frustoconical.

What is claimed is:

1. A warhead for missile having a proximity fuse, comprising:

a fragmentation casing having a longitudinal axis, an outer explosive charge in said casing provided with first detonation means, an inner explosive charge located within said outer explosive charge coaxially to said explosive charge and casing, radially separated from said outer explosive charge by an empty space and provided with second detonation means, said inner charge and outer charge being so arranged that detonation of the inner charge causes detonation of the outer charge caused by the shockwave travelling through the radial space while detonation of the outer charge does not cause detonation of the inner charge, and means for selectively triggering either one of said first and second detonation means.

2. Warhead according to claim 1, wherein said first detonation means comprises an annular detonator at a longitudinal end of said outer charge at least and said outer charge has a radial thickness which varies from a minimum value at a longitudinal end of said outer charge to a maximum value at the other end thereof, according to a variation law which results in a radial distribution of casing fragments in the form of a disk-shaped radially directed isotropic shower.

3. A warhead according to claim 2, wherein said outer charge has said minimum thickness at that end which is provided with said detonator and said minimum thickness is only slightly higher than the thickness necessary for detonation to occur.

4. Warhead according to claim 1, wherein said inner charge consists of an explosive composition which has a lesser sensitivity than said outer charge.

5. Warhead according to claim 1, wherein said inner charge is tightly surrounded by a confinment shroud.

6. Warhead according to claim 2, wherein said casing has a rotational symmetry and is weakened along lines which define fragments having a weight which decreases in the longitudinal direction to be minimum where said outer charge has a maximum thickness.

* * * * *